United States Patent [19]

Brinkman et al.

[11] Patent Number: 4,635,355

[45] Date of Patent: Jan. 13, 1987

[54] TOOL FOR ELECTRICAL TERMINALS

[75] Inventors: Donald J. Brinkman, Woodridge; Russell J. Leonard, Downers Grove, both of Ill.

[73] Assignee: Molex Incorporated, Lisle, Ill.

[21] Appl. No.: 816,527

[22] Filed: Jan. 6, 1986

[51] Int. Cl.[4] ..... H01R 43/00

[52] U.S. Cl. ..... 29/747; 29/758; 29/764; 29/881

[58] Field of Search ..... 29/747, 758, 764, 876, 29/881, 884, 270

[56] References Cited

U.S. PATENT DOCUMENTS 3,896,535 7/1975 Tucci ..... 29/758 X

*Primary Examiner*—Carl E. Hall

*Attorney, Agent, or Firm*—Louis A. Hecht

[57] ABSTRACT

Disclosed is a method and apparatus for extracting an electrical terminal having a canted locking lance from a first housing, and preparing the locking lance of the terminal for insertion in the same or a second similar housing. The connector housing includes an outer wall having a window formed therein for receiving a free end of the locking lance. The lance free end engages an edge of the window when the terminal is fully inserted in the connector housing, thereby preventing withdrawal of the terminal from the housing. A tool is provided with first and second lance engaging portions, the first lance engaging portion including a projection of predetermined dimensions receivable in the window to depress and deform the locking lance, allowing extraction of the terminal from the connector housing. Deformation of the lance is limited to a repairable amount. The second lance engaging portion of the tool includes a hook-like lance reforming member insertable beneath the lance and a floor of the terminal. The hook-like member includes an external rocking surface for engaging the terminal floor. Upon rocking of the hook-like member, the lance is wedged away from the floor so that the deformation thereof is removed, and its original operating performance restored.

4 Claims, 8 Drawing Figures

TOOL FOR ELECTRICAL TERMINALS

BACKGROUND OF THE INVENTION

1. Field of the Invention

The invention pertains to electrical terminals employed in connector assemblies, and in particular to methods and apparatus for removing the terminals from a first connector housing, without damage to those terminals, and preparing the terminals for insertion in a second connector housing. In particular, the present invention is directed to controlling the locking lance retention means formed with the terminal to prevent removal of the terminal once installed in a connector housing.

2. Description of the Prior Art

Electrical terminals are typically installed in a connector housing which includes a terminal receiving cavity defined by one or more housing walls. A popular technique for retaining terminals within the housing, is to strike out a resilient locking lance from an outer surface of the terminal, the lance being formed to extend a predetermined amount above the terminal body. The housing wall adjacent the lance is provided with a window for receiving a free end of the lance, which engages an edge of the window to prevent withdrawal of the terminal from the housing cavity.

An example of this arrangement is given in U.S. Pat. No. 3,706,954 assigned to the assignee of the present invention. The terminal therein has a canted locking lance which is struck out at a given angle to extend in a rearward direction. The terminal is slidingly mounted in a cavity of a dielectric housing, through a rearward end of the housing. A top wall of the housing has a window formed therein communicating with the terminal receiving cavity. When the terminal is fully inserted in the cavity, its locking lance engages a window edge which is received between the lance and the terminal body, to prevent withdrawal of the terminal from the housing cavity. The lance, which is struck out from the terminal body, is sufficiently resilient to be collapsibly deflected by the housing wall during initial stages of terminal insertion, and thereafter resumes its outward deflection upon entering the housing window.

Heretofore, if an electrical connector installed in an electrical component was suspected of being faulty, the electrical wires terminated to the connector were cut, and a new connector was installed in place of the old. Today, however, there are a variety of situations where the terminals, once terminated to electrical wires, are sought to be preserved if at all possible. For example, in the past, when a particular terminal in a connector was suspected (after failing a test probe examination) that terminal was removed from the connector housing without regard to its reinstallation. Even if the terminal removal was only for the purpose of visual inspection, it was assumed that a new terminal would be installed in place of the old.

To remove terminals of the above-described type, an object such as a screwdriver, readily available to the operator, was inserted in the housing window to deflect and deform the locking lance, without regard for its reuse. The terminal was then withdrawn, severed from the electrical wire to which it is terminated, and a new terminal was installed at the end of the wire.

However, terminal replacement is not always possible. In certain installations, the the wire length cannot be shortened, or even extended by a wire splice (for purposes of circuit integrity, or difficulty in achieving a reliable wire splice). Further, with increasing miniaturization of electrical connectors and electrical terminals, it is becoming increasingly difficult to achieve a convenient reliable termination in a field condition. This is true, for example, of miniaturized electrical connectors having insulation displacing terminals which are terminated to very small wire gauges. Also, with increasing costs of gold and other precious metals employed in terminal construction, terminal reinstallation is desired since it saves discarding the terminal and stocking an inventory for repair personnel. Also significant time savings can be realized if a terminal can be reused. This is particularly true when, for example, in data connection circuits, where circuit positions must be changed within a connector housing.

SUMMARY OF THE INVENTION

For these reasons, a convenient apparatus and method has been sought for reusing electrical terminals that are installed in a connector housing. The problem solved by the present invention, is to maintain the structural integrity and reliable performance of the locking lance even after it is deformed to allow removal from the connector housing. As will be appreciated by those skilled in the art, the original position of the locking lance and operating performance of the lance material is critical, since it directly determines the pull-out resistance imparted to an electrical terminal.

It is therefore an object of the present invention to provide a method and apparatus for removing a terminal having a resilient locking lance from a connector housing without irreparable deformation, and preparing the locking lance of the terminal, once removed from the housing, for reinstallation in the same or another similar connector housing.

Another object of the present invention is to provide a method and apparatus for easily and reliably reconfiguring the deformed locking lance so that it closely attains its original design configuration, thereby providing reliable terminal pull-out retention.

A related object of the present invention is to provide a method and apparatus for deforming the locking lance of a terminal installed in a connector housing, such that the lance remains repairably deformed allowing withdrawal of the terminal from the housing, but which can easily be reformed to its original operating performance at a later stage.

Yet another object of the present invention is to provide a method and apparatus for removing an reinstalling terminals having resilient locking lances, which can be conveniently employed even with miniaturized electrical terminals.

These and other objects of the present invention are provided in a manually operable tool for inserting and extracting an electrical terminal into and out of a dielectric connector housing. The housing includes a terminal receiving cavity at least partially defined by an outer wall with a window formed therein, the terminal includes a body having opposing top and floor walls, a resilient locking lance struck out a predetermined amount and extending at a given angle from the top wall, the lance having a free end in the window and engaging an edge of the window when the terminal is fully inserted in the cavity prevent withdrawal of the terminal from the housing cavity. The tool comprises a unitary stamped body including first and second lance engaging portions, the first lance engaging portion including a stop surface for externally engaging the housing wall and a terminal engaging projection extending from the stop surface and receivable in the window to deformably depress the lance toward the terminal floor a predetermined amount to push the lance out of the window and into the terminal receiving cavity so that the lance is spaced with no less than a minimum gap from the floor, whereby when the first lance engaging portion is advanced toward said housing, the stop surface engages the outer housing wall to limit the penetration of the projection into the window to thereby limit the depression of the lance to the predetermined amount. The second lance engaging portion including a hook-like lance reforming member having a tip, formed by the joinder of an inner lance engaging surface and an outer floor engaging rocking surface, insertable in the gap, whereby when the tip is inserted in the gap between the deformed lance and the body, and the second body portion of the tool is rocked against the floor, the lance is deflected away from the floor so as to be restored in its original angle and position, so that upon insertion in the housing, the lance will engage the window edge.

The objects of the present invention are also provided in a method of extracting an electrical terminal from a first dielectric housing and inserting the terminal in a second similar housing, the housings including a terminal receiving cavity at least partially defined by an outer wall with a window formed therein, the terminal including a body having opposing top and floor walls, a resilient locking lance struck out a predetermined amount and extending at a given angle from the top wall, the lance having a free end in the window and engaging an edge of the window when the terminal is fully inserted in the cavity for engaging an edge of the window to prevent withdrawal of the terminal from the housing cavity, the method comprising the steps of, depressing the lance toward the terminal floor a predetermined amount so as to deform the lance a predetermined amount, extracting the terminal from the first housing, and deflecting the deformed lance away from the terminal floor to reform the lance to the predetermined angle and to substantially remove the deformation, whereby upon insertion of the terminal in the second housing, the free end of the locking lance is received in a window thereof to engage an edge of the window, preventing withdrawal of the terminal from the second housing cavity.

BRIEF DESCRIPTION OF THE DRAWINGS

In the drawings, wherein like elements are referenced alike.

DETAILED DESCRIPTION OF THE PREFERRED EMBODIMENT

Figure 1:
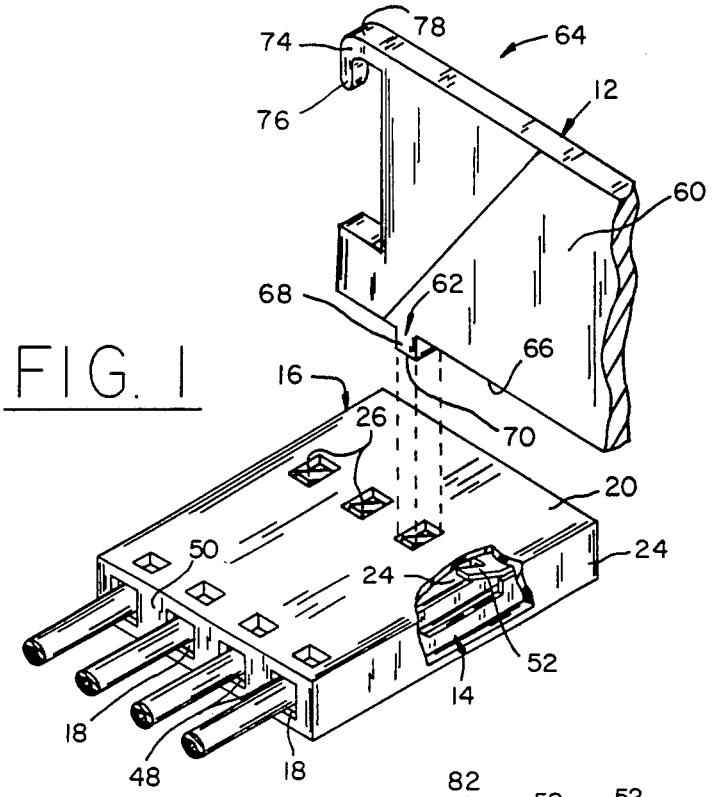
FIG. 1 is a perspective view of a connector and the tool of the present invention.
Figure 5:
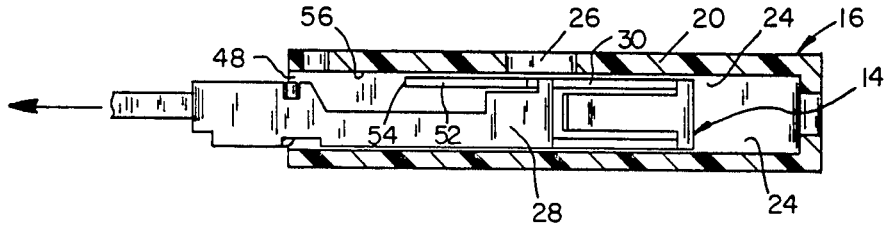
FIG. 5 shows the terminal of the preceding figures with its locking lance deformed, being withdrawn from the housing of FIG. 1.
Figure 6:
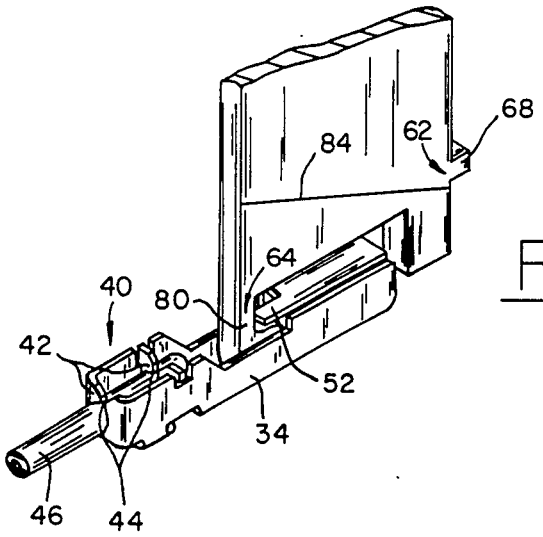
FIG. 6 is a perspective view of the terminal of FIG. 5, withdrawn from a connector housing, with the tool of FIG. 1 being applied thereto to reform the lance.

Referring to the drawings, and initially to FIGS. 1 and 6, a manually operable tool of the present invention, generally indicated at 12, is shown. Tool 12 is used for the extraction and subsequent insertion of electrical terminals generally indicated at 14, out of and into a dielectric connector housing generally indicated at 16. Terminal 14 and housing 16 are of the type shown and described in U.S. Pat. No. 3,706,954 assigned to the assignee of the present invention, herein incorporated by reference to the extent necessary for an understanding of the present invention. Briefly, housing 16 includes terminal receiving cavities, 18 defined by an upper outer housing wall 20 common to all cavities and opposed lower outer walls 22 also common to all cavities, and a plurality of upstanding sidewalls 24 which enclose each cavity 18. In the particular embodiment shown, cavities 18 are generally rectangular in cross-section, although other configurations are also possible. Each cavity 18 has associated therewith a window 26 formed in the upper housing wall 20. Window 26 and cavity 18 form a continuous opening as is shown in any of the electrical cross sectional FIGS. 2, 3 or 5.

Referring generally to the drawings, terminal 14, also described in the forementioned U.S. Pat. No. 3,706,954, includes a body 28 having opposing top and floor walls 30, 32, respectively joined to a pair of opposed sidewalls 34. A pin-receiving mating portion 36 is formed at the forward end of terminal 14, which is aligned with a terminal receiving opening 38 in housing 16.

As best shown in FIG. 6, the rearward end of terminal 14 has a wire engaging portion 40 including a pair of walls 42 each defining an insulation displacing slot 44. An insulation-clad wire 46 is shown terminated in portion 40, the insulation cladding thereof being displaced to allow electrical contact between the central conductor thereof and walls 42. Wires 46 are typically terminated to terminals 14 outside of housing 16, and are thereafter telescopically inserted through terminal receiving apertures 48 formed at a rearward end wall 50 of housing 16. Once inserted through apertures 48, the terminated wire/terminal assemblies are positioned in terminal-receiving cavities 18.

Figure 2:
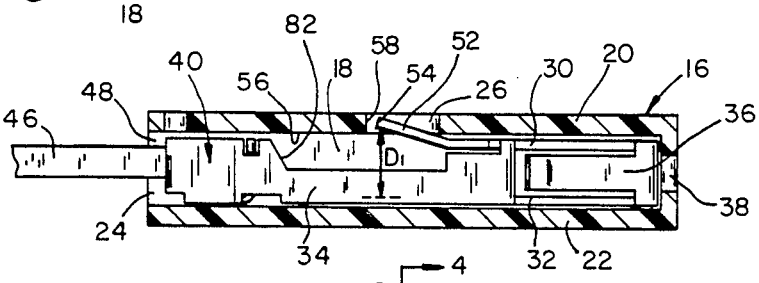
FIG. 2 is a sectional view of a terminal of FIG. 1 shown in its fully installed position, prior to extraction.

To provide retention of terminal 14 within housing 16, a resilient locking lance 52 is struck out of the top terminal wall 30 a predetermined amount, so as to extend at a given angle from the top terminal wall. The reference label D1 is shown in FIG. 2 to indicate the distance between a free end 54 of lance 52, and bottom terminal wall 32. As indicated in FIG. 2, the vertical distance between lance free end 54 and the outside surface of floor wall 32 is greater than the vertical height of cavity 18 (measured between the internal surfaces of housing upper wall 20 and lower wall 22). Thus, as terminal 14 is inserted into cavity 18, the upper surface of lance 52 cams against the upper edge of terminal receiving aperture 48, with the lance being thereby resiliently depressed as it slides along the upper inside cavity surface 56, as is known in the art. Upon full insertion of terminal 14 within cavity 18, lance 52, and particularly the free end 54 thereof, is brought into alignment with window 26. Owing to the resilient construction of lance 52, its free end 54 enters the window with an upward deflection, being free undeflected to assume its initial upward position.

Upon application of a pull out tension to wire 46, the terminal 14 is pulled in a backward direction so as to bring the free end 54 of lance 52 engagement with the rearward edge 58 of window 26, thereby preventing further rearward displacement of terminal 14 in cavity 18. As appreciated by those skilled in the art, the angular orientation of lance 52, as it engages window edge 58, directly determines the pull-out resistance force provided by the lance. As such, the particular angle of lance 52 relative to the terminal body and also relative to the top wall 20 of housing 16, is a critical parameter controlling the lance's retention capability. As indicated in FIG. 2, a convenient way of determining this angle is to measure the distance D1 from the upper or insidesurface of terminal floor wall 32 to the bottom tip of lance free end 54.

Figure 4:
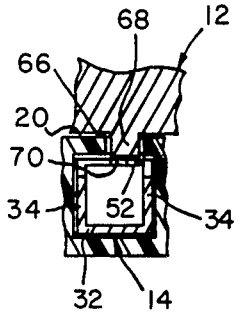
FIG. 4 is a cross sectional view taken along the lines 4—4 of FIG. 3.
Figure 3:
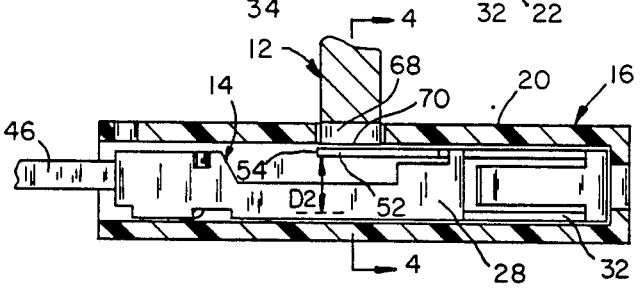
FIG. 3 shows the terminal of FIG. 2 with its locking lance depressed by the tool of FIG. 1.

The foregoing describes a conventional connector assembly wherein a terminal 14 is fully installed in a housing 16. According to the present invention, FIGS. 3–5 show how terminal 14 is prepared for withdrawal from cavity 18 in a manner which ensures the proper subsequent operation of lance 52. To accomplish this, tool 12 is provided with (see FIG. 1 or 7) a unitary stamped body portion 60 having a first lance engaging portion 62 used for withdrawal of the terminal, and a second lance engaging portion 64 used to prepare the lance for reinsertion in the same or a similar housing cavity.

First lance engaging portion 62 includes an external stop surface 66 for externally engaging the upper housing wall 20. The terminal engaging projection 68 extends from stop surface 66 a predetermined amount equal to the difference between the distance D1 shown in FIG. 2, and the distance D2 shown in FIG. 3, each distance being measured from the lower tip of lance free end 54 and the inside or upper surface of terminal floor wall 32. Projection 68 has a cross-sectional configuration which is receivable in window 26, as shown in FIG. 3. As indicated in FIG. 3, the projection 68 has a free end 70 which engages lance 52, pushing that lance toward terminal floor wall 32 as the projection is telescopically inserted in window 26.

The degree of penetration of projection 68 is limited by engagement of stop surface 66 with the external outer surface of upper wall 20. Projection 68 is dimensioned so as to deflect lance 52 only an amount suffucient to deform that lance to prevent engagement with housing surface 56 upon subsequent withdrawal of the terminal from the housing (see FIG. 5). The length or amount of extension of projection 68 can be readily determined by those skilled in the art, once the thickness of upper housing wall 20 and the difference in height between the vertical height of cavity 18 and the vertical height of terminal 14 are determined. In practice, manufacturers of electrical connector assemblies must provide some gap or "free play" by making the height of terminal 14 slightly less than the height of the terminal receiving cavity 18, to provide easy movement of the terminal within the housing cavity.

The length, or amount of extension of projection 68 is critical. If projection 68 is not long enough, free lance end 54 may not be deflected sufficiently so as to disengage window edge 58, or alternatively, even if the window edge 58 is cleared, the lance might spring back so as to reengage that edge. However, if the projection 68 is too long, lance 52 will be deflected toward reliable terminal floor wall 32 a distance less than D2 as indicated in FIG. 3. This increases the risk of permanently deforming the lance 52, thereby impairing its resilience quality necessary for terminal retention. Also, too great a deflection of lance 52 will close the gap between lance free end 54 and terminal floor wall 32 to a point where tooling cannot be inserted underneath the lance to restore it to its original configuration.

As indicated in FIG. 3, projection 68, when fully received in window 26 (as defined by the engagement between stop surface 66 and the upper surface of housing wall 20) is sufficient to repairably deform lance 52 so that it no longer engages upper inside housing surface 56. Terminal 14 can thereafter be conveniently withdrawan from housing 16.

Figure 7:
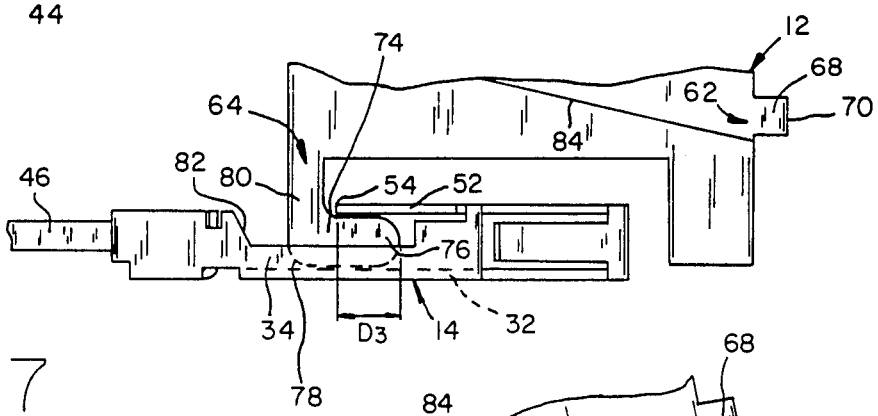
FIG. 7 is a side elevational view of FIG. 6.
Figure 8:
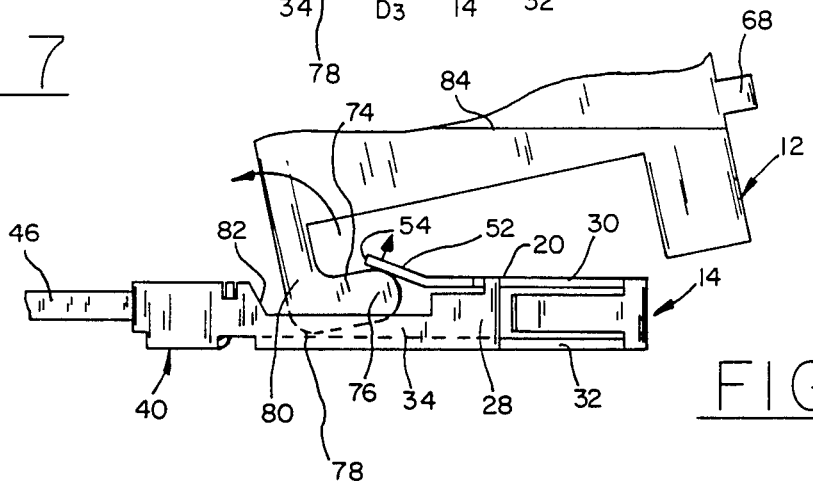
FIG. 8 shows operation of the tool of the present invention resetting the locking lance to its desired position, rendering the terminal ready for reinsertion in a connector housing.

Referring now to FIGS. 6–8, the second lance engaging portion 64 of tool 12 is used to reform lance 52 to its original configuration (as shown in FIG. 2) and operating performance. The lance is restored its original resilient spring force, while avoiding work-hardening or other fatiguing of the terminal metal particularly at the hinge or flex point where lance 52 is joined to the body 28.

As indicated above, the distance D2, spanning the gap between lance free end 54 and terminal floor wall 32, prevents irreparable deformation of lance 52 at its point of joinder with terminal body 28. But, further, the gap D2 is necessary to allow tooling to be inserted between terminal floor wall and lance free end 54 which restores lance 52 to its original configuration and operating characteristics. The second lance engaging portion 64 of tool 12 is conveniently provided for this purpose. Portion 64 includes a hook-like lance reforming member 74 having a tip 76 insertable in gap D2. In the preferred embodiment, hook like member 74 is generally L-shaped, but other configurations will become apparent to those skilled in the art. An outer floor-engaging rocking surface 78 is formed by rounding the corner of the L-shaped member.

Insertion of the tool in gap D2 is shown in FIGS. 6 and 7, wherein hook-like member 74 is conveniently inserted in the gap D2 (shown in FIG. 3) so as to come to rest against terminal floor wall 32. As indicated in FIG. 7, the gap is just slightly larger than the vertical height of tip 76, and the tip 76 is elongated so with a length D3, that a tacktile indication of intimate engagement between tip 76 and terminal floor wall 32 is provided to the operator. Further, the connecting portion 80, which joins tip 76 to body 60, is positioned between free lance end 54 and the leading end 82 of wire engaging portion 40 to provide convenient locating of tip 76 relative to lance 52. In the preferred embodiment this location is assured by the length D3 of tip 76. This length is defined by the point where connecting portion 80 engages lance free end 54. As shown in FIG. 8, tool 12 is rotated by the operator in a counterclockwise direction so as to rock surface 78 against terminal floor wall 32, effectively elevating tip 76 in a controlled manner.

A reference line 84 is conveniently provided on a surface of tool 12 to provide a ready visual indication when parallelism of that line with terminal top wall 30, top surface 20, or terminal floor wall 32 is achieved. Reference line 84 provides a convenient angle measurement of the amount of rocking of tool 12, and hence of the amount of deflection of lance 52 away from terminal floor wall 32.

The opening between lance free end 54 and wire engaging leading end 82 may be made sufficiently small to confine connecting portion 80 to a controlled position relative to lance 52. This is an alternative way of assuring control over the point of engagement where tip 76 engages the lower or inside surface of lance 52, (thereby ensuring the accuracy of the angle measurement provided by a parallel indication between reference line 54 in either the top or floor terminal walls 30, 32). With proper dimensioning of the opening portion 80 can be made to rock against end 82 to control the rocking movement, including limiting the angular rotation of tool 12.

Upon withdrawal of tool 12 from terminal 14, lance 52 and terminal 14 are ready for reinsertion in the same or a similar housing. Lance 52 is restored not only to its original distance D1 from terminal floor wall 32, but is also restored to its original angle and position as well as its original resilient characteristics, since work hardening or other fatiguing of the joinder between lance 52 and terminal body 28 is avoided.

As indicated in FIGS. 4, 7 and 8, terminal 14 can, if desired, be conveniently provided with sidewalls 34 which captivate tip portion 76 and its adjacent rocking surface 78, so as to prevent a sideways or lateral misalignment of tip 76 relative to lance 52. Sidewalls 34 and terminal floor wall 32 for a U-shaped channel which prevents sideways pivotting of second lance engaging portion 64 (i.e. in a horizontal plane) as that portion is rocked in a vertical plane.

I claim:

1. A manually operable tool for inserting and extracting an electrical terminal into and out of a dielectric connector housing, said housing including a terminal receiving cavity at least partially defined by an outer wall with a window formed therein, said terminal including a body having opposing top and floor walls, a resilient locking lance struck out a predetermined amount and extending at a given angle from said top wall, the lance having a free end in the window and engaging an edge of the window when the terminal is fully inserted into the cavity to prevent withdrawal of the terminal from the housing cavity, the tool comprising:

a unitary stamped body including first and second lance engaging portions;

said first lance engaging portion including a stop surface for externally engaging the housing wall, and a terminal engaging projection extending from the stop surface and receivable in the window to deformably depress the lance toward the terminal floor a predetermined amount to push the lance out of the window and into the terminal receiving cavity so that said lance is spaced with no less than a minimum gap from said floor, whereby when said first lance engaging portion is advanced toward said housing, said stop surface engages said outer housing wall to limit the penetration of said projection into said window to thereby limit the depression of said lance to said predetermined amount; and said second lance engaging portion including a hook-like lance reforming member having a tip formed by the joinder of an inner lance engaging surface and an outer floor engaging rocking surface, insertable in said gap, whereby when said tip is inserted in the gap between said deformed lance and said body, and said second body portion of said tool is rocked against said floor, said lance is deflected away from said floor so as to be restored to its original angle and position, so that upon insertion in said housing, said lance will engage said window edge.

2. The tool of claim 1 wherein said terminal has a pair or opposed sidewalls forming a U-shaped channel with said terminal floor, and said second lance engaging portion adjacent said rocking surface thereof is configured to remain in said channel as said tool is rocked, whereby said tip is maintained in alignment with said lance during reforming of said lance.

3. The tool of claim 1 wherein said terminal is elongated, and said tool body contains a reference line which is brought into alignment with the longitudinal axis of said terminal as said tool is rocked, to provide a visual indication of the amount of rocking necessary to reform said lance.

4. The tool of claim 1 wherein said hook-like lance deforming member contains a connecting portion between said tip and said tool body, said connecting portion receivable between said locking lance and another terminal body portion spaced from said floor wall, said connecting portion engaging said other terminal body portion during rocking of said tool to further maintain said tip in alignment with said lance during reforming of said lance.

* * * * *